US008337221B1

(12) United States Patent
Huang et al.

(10) Patent No.: US 8,337,221 B1
(45) Date of Patent: Dec. 25, 2012

(54) TRANSMISSION APPARATUS

(75) Inventors: Chao-Jui Huang, New Taipei (TW); Wen-Nan Huang, New Taipei (TW)

(73) Assignee: Chicony Power Technology Co., Ltd., New Taipei (TW)

( * ) Notice: Subject to any disclaimer, the term of this patent is extended or adjusted under 35 U.S.C. 154(b) by 0 days.

(21) Appl. No.: 13/237,893

(22) Filed: Sep. 20, 2011

(51) Int. Cl.
*H01R 13/648* (2006.01)

(52) U.S. Cl. ..... 439/98; 439/502; 174/113 R

(58) Field of Classification Search ..... 439/98, 439/502, 101, 108; 174/113 R
See application file for complete search history.

(56) References Cited

U.S. PATENT DOCUMENTS

| | | | | |
|---|---|---|---|---|
| 4,820,175 | A * | 4/1989 | Hasegawa et al. | 439/98 |
| 5,945,631 | A * | 8/1999 | Henrikson et al. | 174/34 |
| 6,310,286 | B1 * | 10/2001 | Troxel et al. | 174/36 |
| 8,071,880 | B2 * | 12/2011 | Groegl et al. | 174/110 R |
| 8,269,829 | B2 * | 9/2012 | Miller et al. | 348/82 |
| 2001/0054123 | A1 * | 12/2001 | Henrikson et al. | 710/100 |
| 2003/0073331 | A1 * | 4/2003 | Peloza et al. | 439/108 |
| 2003/0121694 | A1 * | 7/2003 | Grogl et al. | 174/113 R |
| 2010/0081302 | A1 * | 4/2010 | Atkinson et al. | 439/98 |
| 2010/0221933 | A1 * | 9/2010 | Wu | 439/98 |
| 2012/0008904 | A1 * | 1/2012 | Han et al. | 385/101 |
| 2012/0135642 | A1 * | 5/2012 | Chang | 439/630 |

* cited by examiner

*Primary Examiner* — Gary F. Paumen
(74) *Attorney, Agent, or Firm* — Chun-Ming Shih; HDLS IPR Services

(57) ABSTRACT

A transmission apparatus includes a wire cable and at least one connector. The wire cable has an insulating external layer, a differential signal line group, an AC power line group, and a metal shielding layer. The insulating external layer covers the differential signal line group, the AC power line group, and the metal shielding layer. The differential signal line group has a plurality of signal transmission lines. The AC power line group has a plurality of power lines. The metal shielding layer isolates the differential signal line group and the AC power line group. Each connector has an insulating external case and a plurality of conductive terminals. The insulating external case covers the conductive terminals. Each conductive terminal has a pin and the pins of the conductive terminals are electrically connected to the signal transmission lines, the power lines, and the metal shielding layer.

14 Claims, 6 Drawing Sheets

TRANSMISSION APPARATUS

BACKGROUND OF THE INVENTION

1. Field of the Invention

The present invention relates generally to a transmission apparatus, and more particularly to a transmission apparatus having a plurality of signal transmission lines and a plurality of power lines combined to the signal transmission lines.

2. Description of Prior Art

A photovoltaic panel is used to convert solar energy into electric energy. Because of limitation of the resources on Earth, the solar energy is a significant energy source. In addition, the solar energy is an important alternative energy with growing concerns over environmental protection and energy conservation.

In order to convert solar energy into electric energy, appropriate electronic devices are required. Hence, signal transmission lines and power lines are used to provide communication between the electronic devices. For the prior art applications, the signal transmission lines and the power lines are separated. That is, signal transmission and power transmission are achieved by different special wire cables, respectively. However, the costs of the used wire cables and layouting the same are not inexpensive.

Because of the separation of the signal transmission lines and the power lines, water-proof and dust-proof devices are required for protecting the signal transmission lines and the power lines, thus increasing the complexity and the costs of the transmission devices. In addition, the required communication hardware circuits are complicated and expensive if the technology of power line communication (PLC) is used. Furthermore, the communication reliability would be reduced if the ZigBee is used for wireless communication due to the absence of the signal transmission lines.

SUMMARY OF THE INVENTION

An object of the invention is to provide a transmission apparatus with a combination of a plurality of signal transmission lines and power lines to solve the above-mentioned problems.

In order to achieve the above object, the transmission apparatus includes a wire cable and at least one connector. The wire cable has an insulating external layer, a differential signal line group, an AC power line group, and a metal shielding layer. The insulating external layer covers the differential signal line group, the AC power line group, and the metal shielding layer. The differential signal line group has a plurality of signal transmission lines. The AC power line group has a plurality of power lines. The metal shielding layer isolates the differential signal line group and the AC power line group. Each connector has an insulating external case and a plurality of conductive terminals. The insulating external case covers the conductive terminals. Each conductive terminal has a pin and the pins of the conductive terminals are electrically connected to the signal transmission lines, the power lines, and the metal shielding layer.

BRIEF DESCRIPTION OF DRAWING

The features of the invention believed to be novel are set forth with particularity in the appended claims. The invention itself, however, may be best understood by reference to the following detailed description of the invention, which describes an exemplary embodiment of the invention, taken in conjunction with the accompanying drawings, in which:

DETAILED DESCRIPTION OF THE INVENTION

Figure 1:
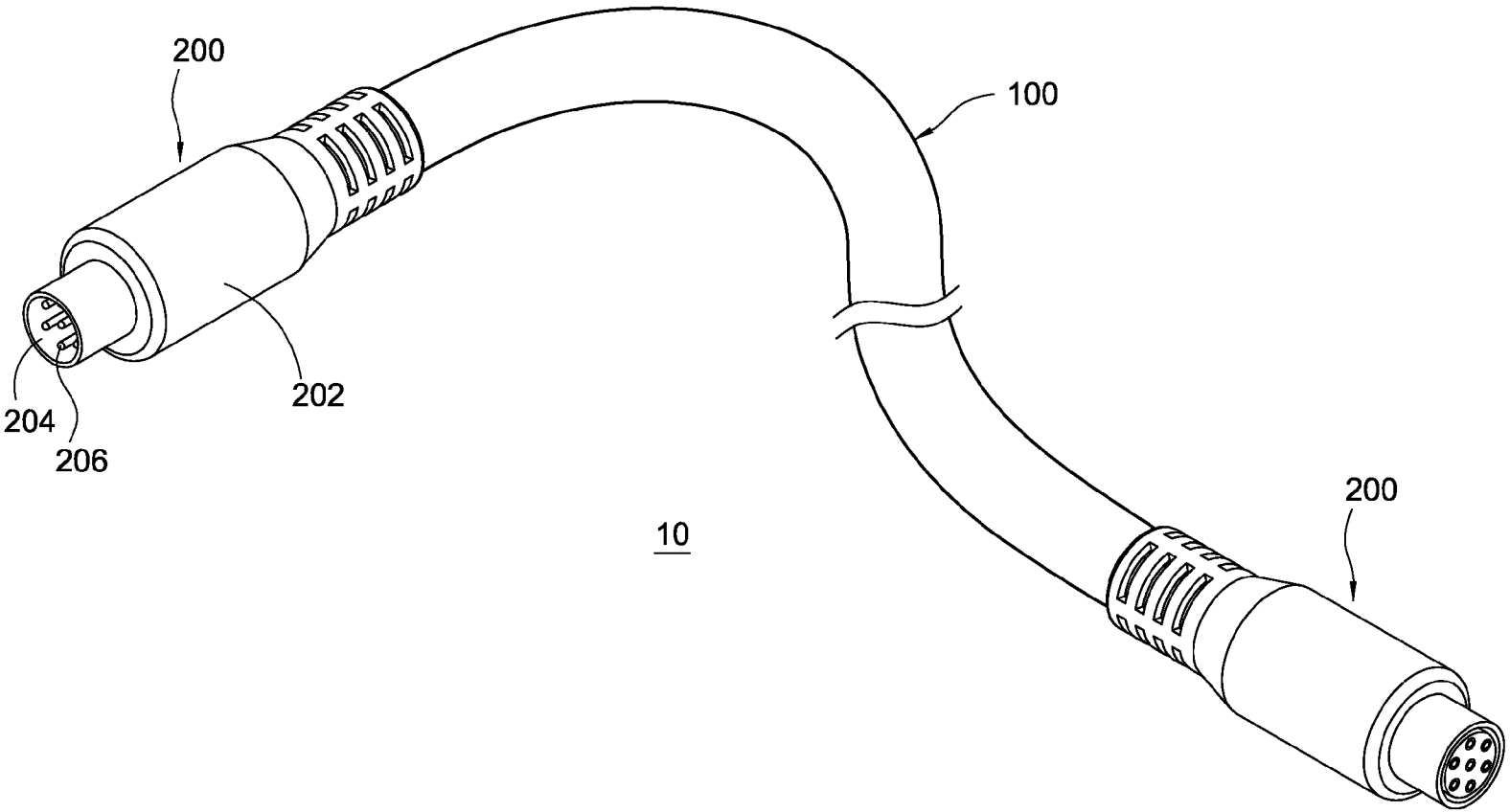
FIG. 1 is a perspective view of a transmission apparatus according to a first embodiment of the present invention.

Reference will now be made to the drawing figures to describe the present invention in detail.

Figure 2:
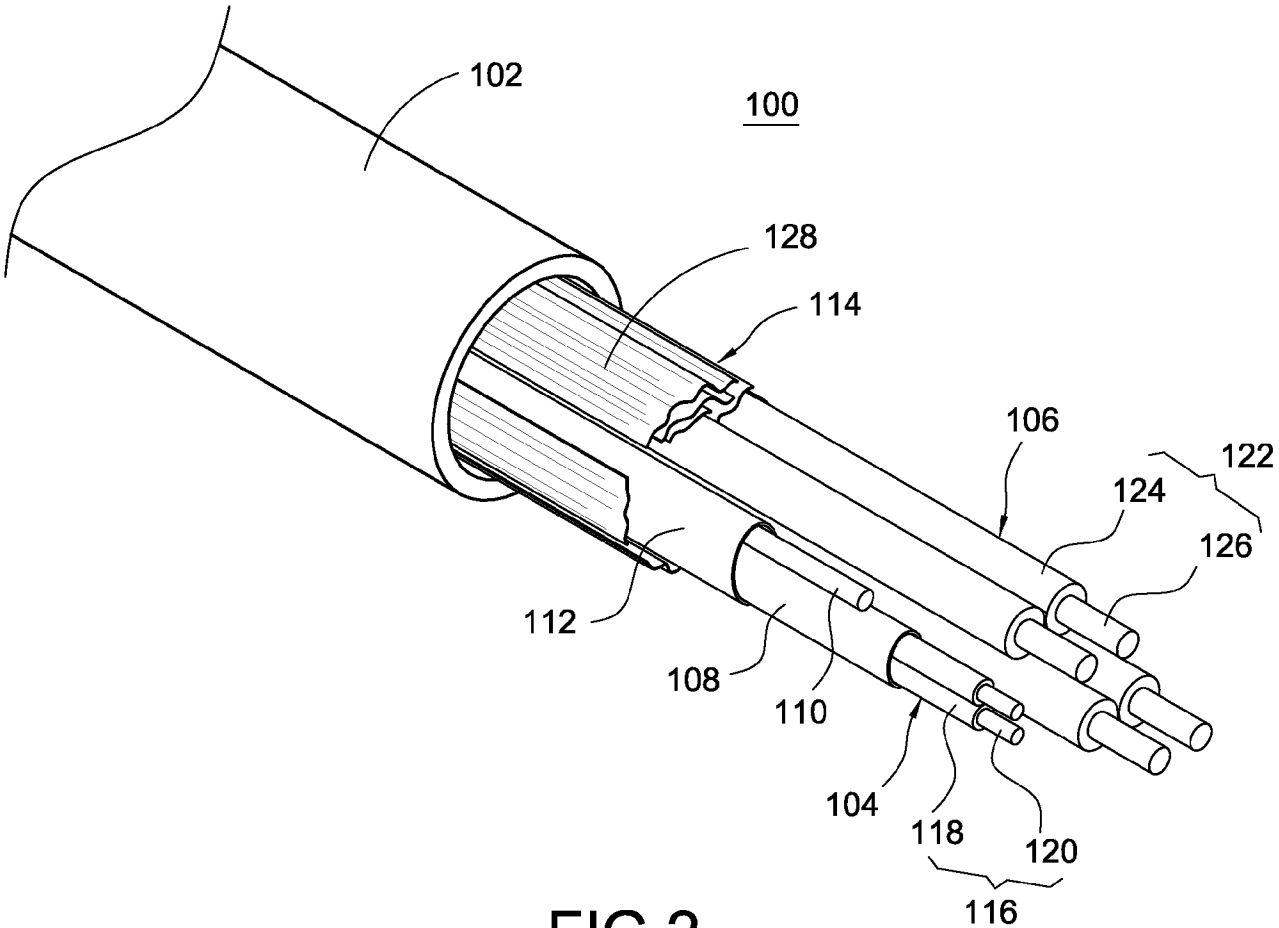
FIG. 2 is a perspective view of a wire cable according to the present invention.
Figure 3:
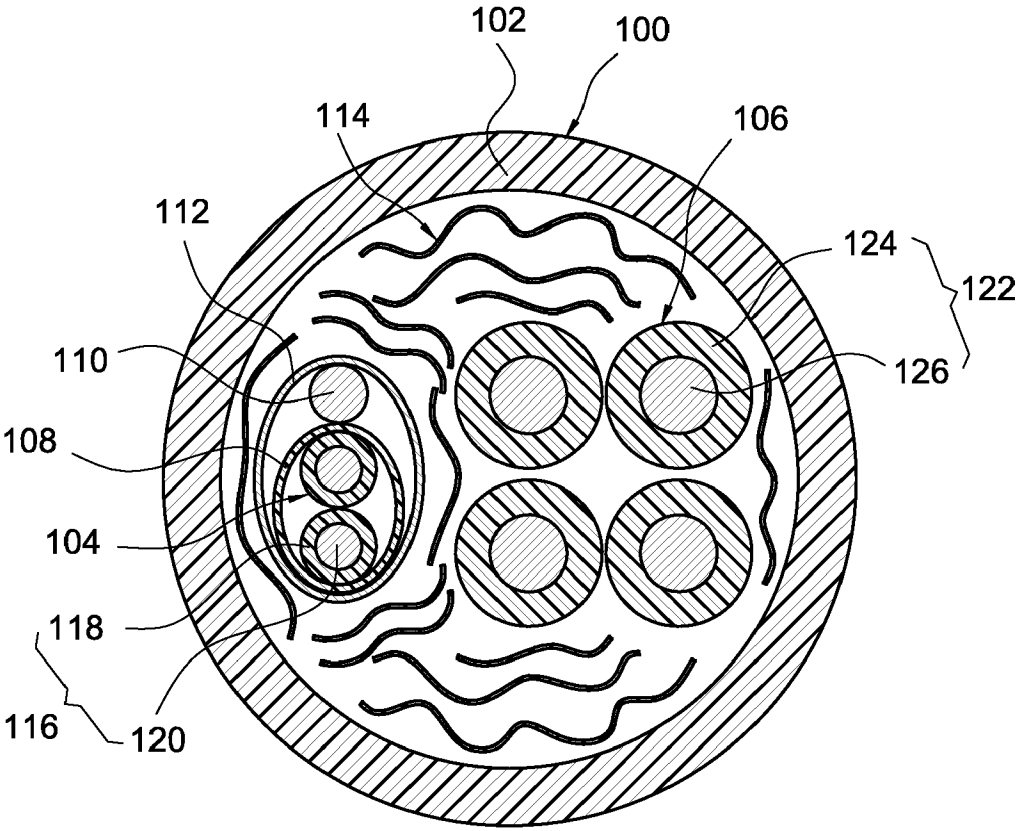
FIG. 3 is a cross-sectional view of the wire cable according to the present invention.

Reference is made to FIG. 1, FIG. 2, and FIG. 3 which are a perspective view of a transmission apparatus according to a first embodiment of the present invention, a perspective view of a wire cable according to the present invention, and a cross-sectional view of the wire cable according to the present invention, respectively. The transmission apparatus 10 includes a wire cable 100 and at least one connector 200.

The wire cable 100 has an insulating external layer 102, a differential signal line group 104, an AC power line group 106, a metal shielding layer 108, a metal shielding layer connecting line 110, an insulating encapsulating layer 112, and a packing stuff 114. The insulating external layer 102 covers the differential signal line group 104, the AC power line group 106, the metal shielding layer 108, the metal shielding layer connecting line 110, the insulating encapsulating layer 112, and the packing stuff 114.

The differential signal line group 104 has a plurality of signal transmission lines 116. Each signal transmission line 116 has an insulating layer 118 and a conductive line 120. The insulating layer 118 covers the conductive line 120.

The AC power line group 106 has a plurality of power lines 122. Each power line 122 has an insulating layer 124 and a conductive line. The insulating layer 124 converts the conductive line 126.

All of the power lines 122 can be hot lines. Probably, one part of the power lines 122 are hot lines and the rest part of the power lines 122 are neutral lines. Probably, one part of the power lines 122 are hot lines and the rest part of the power lines 122 are ground lines. Probably, one part of the power lines 122 are hot lines, one part of the power lines 122 are neutral lines, and the rest part of the power lines 122 are ground lines.

The metal shielding layer 108 is provided to isolate the differential signal line group 104 and the AC power line group 106 to restrain a crosstalk between the differential signal line group 104 and the AC power line group 106, thus increasing electromagnetic compatibility (EMC) of the wire cable 100.

In an embodiment, the metal shielding layer 108 covers the differential signal line group 104 or the AC power line group 106, in particular, the metal shielding layer 108 covers the differential signal line group 104 as shown in FIG. 2 and FIG. 3. In another embodiment, the metal shielding layer 108 does not cover the differential signal line group 104 or the AC power line group 106, but the metal shielding layer 108 is provided to isolate the differential signal line group 104 and the AC power line group 106.

The insulating encapsulating layer 112 covers the metal shielding layer 108 and the metal shielding layer connecting line 110 so that the metal shielding layer connecting line 110 is electrically contacted to the metal shielding layer 108.

The packing stuff 114 is composed of a plurality of insulating lines 128 to reduce the frictional force, thus preventing the differential signal line group 104 being is broken by the AC power line group 106. The insulating lines 128 can be a PP rope or a glass tape.

If the metal shielding layer 108 covers the differential signal line group 104 (as shown in FIG. 2 and FIG. 3), the packing stuff 114 fills gaps between the insulating encapsulating layer 112 and the AC power line group 106.

If the metal shielding layer 108 covers the AC power line group 106, the packing stuff 114 fills gaps between the insulating encapsulating layer 112 and the differential signal line group 104.

In one embodiment, if the transmission apparatus 10 does not include the metal shielding layer connecting line 110 and the insulating encapsulating layer 112 and the metal shielding layer 108 covers the differential signal line group 104, the packing stuff 114 fills gaps between the AC power line group 106 and the metal shielding layer 108.

In another embodiment, if the transmission apparatus 10 does not include the metal shielding layer connecting line 110 and the insulating encapsulating layer 112 and the metal shielding layer 108 covers the AC power line group 106, the packing stuff 114 fills gaps between the differential signal line group 104 and the metal shielding layer 108.

In further another embodiment, if the transmission apparatus 10 does not include the metal shielding layer connecting line 110 and the insulating encapsulating layer 112, the packing stuff 114 fills gaps between the differential signal line group 104, the AC power line group 106, and the metal shielding layer 108.

Figure 5:
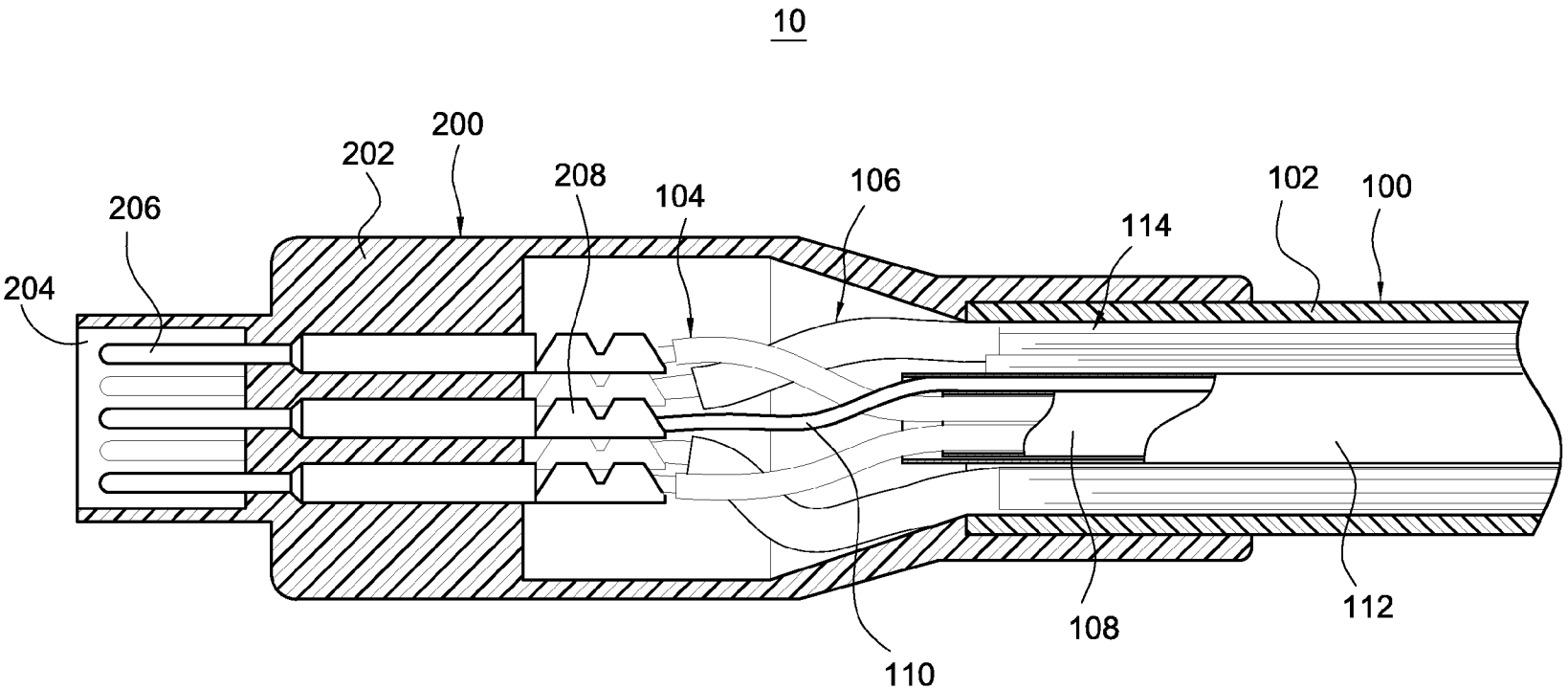
FIG. 5 is a cross-sectional view of the transmission apparatus according to the first embodiment of the present invention.

The connector 200 includes an insulating external case 202, a socket 204, and a plurality of conductive terminals 206. The insulating external case 202 covers the conductive terminals 206. The socket 204 is installed on one side of the insulating external case 202. Each of the conductive terminals 206 has a pin 208 as shown in FIG. 5. The pins 208 of the conductive terminals 206 are electrically connected to the signal transmission lines 116, the power lines 122, and the metal shielding layer 108. The metal shielding layer connecting line 110 is electrically contacted to the metal shielding layer 108 and then connected to the pin 208 of the conductive terminal 206.

The signal transmission lines 116 are wound to each other to increase electromagnetic sensibility (EMS). The power lines 122 are would to each other to reduce electromagnetic interference (EMI).

Figure 4:
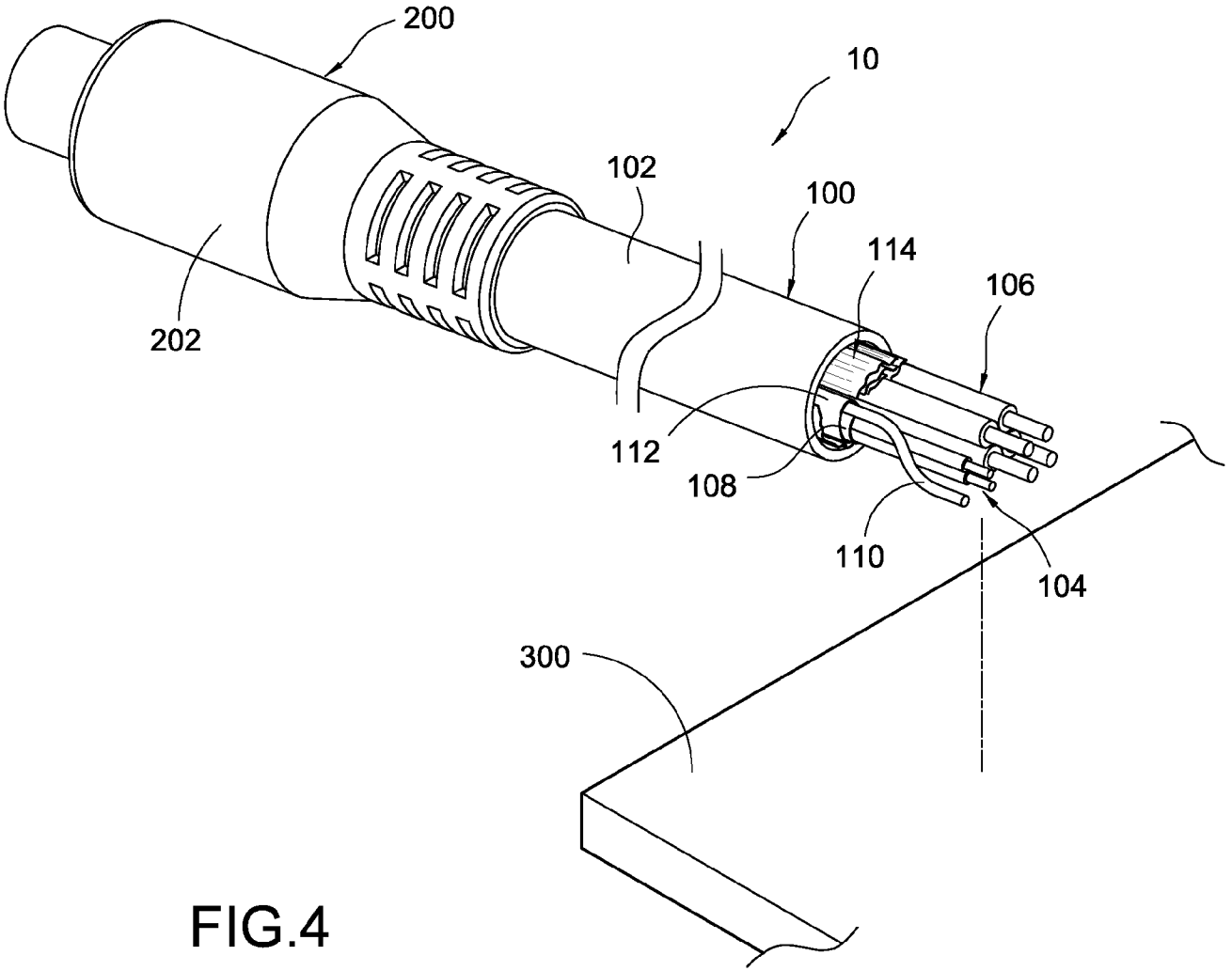
FIG. 4 is a perspective view of a transmission apparatus according to a second embodiment of the present invention.

Reference is made to FIG. 4 which is a perspective view of a transmission apparatus according to a second embodiment of the present invention. An amount of the connector 202 can be one or more than one. The wire cable 100 is welded or electrically connected to a printed circuit board 300.

In another embodiment, the amount of the connector 202 is two; one of the connectors 202 is a convex male connector and the other of the connector is a concave female connector, as shown in FIG. 1. The amount of the signal transmission lines 116 is two, the amount of the power lines 122 is four, and the amount of the conductive terminals 206 is seven. The conductive terminals 206 are electrically connected to the two signal transmission lines 116, the four power lines 122, and the metal shielding layer 108.

After the metal shielding layer connecting line 110 is electrically contacted to the metal shielding layer 108, the metal shielding layer connecting line 110 is connected to the pin 208 of the of the conductive terminal 206 (as shown in FIG. 5), but not limited.

Figure 6:
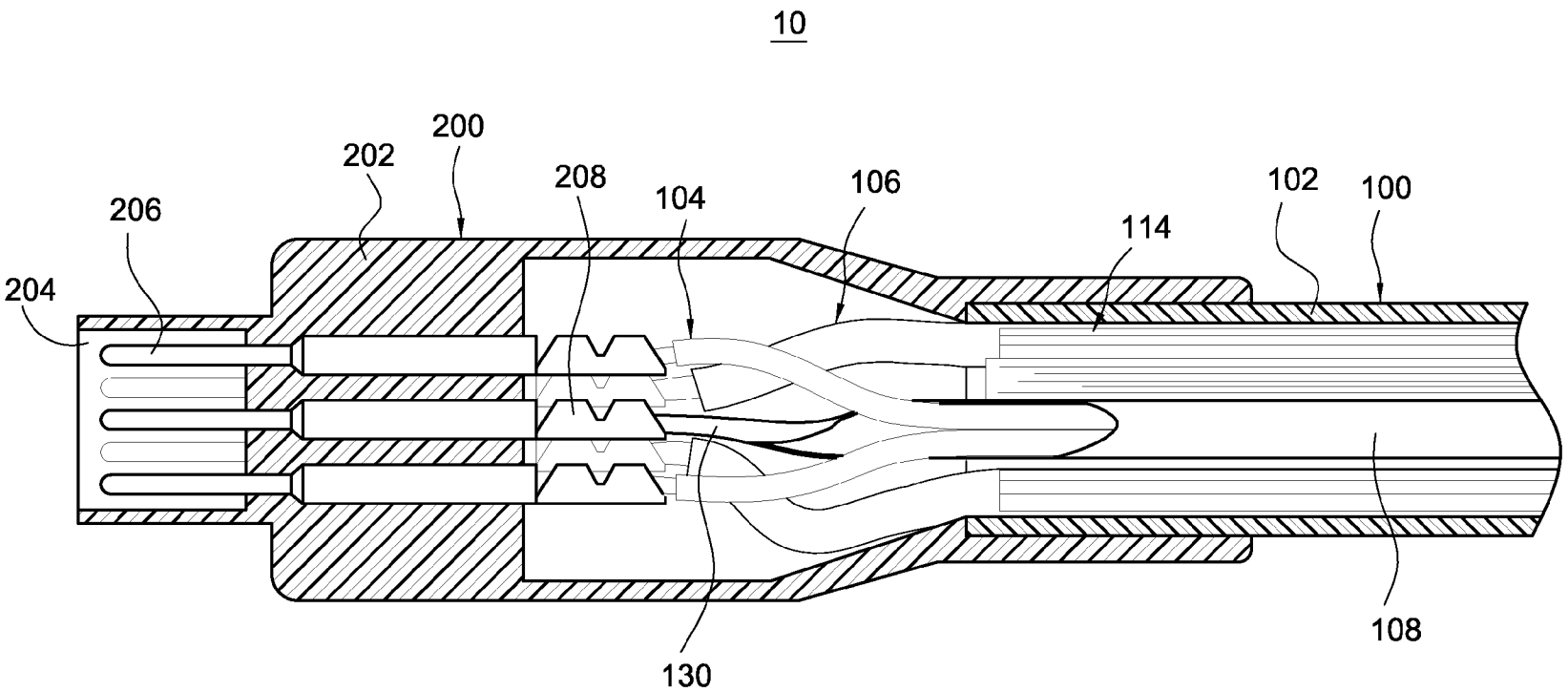
FIG. 6 is a cross-sectional view of the transmission apparatus according to the second embodiment of the present invention.

Reference is made to FIG. 6 which is a cross-sectional view of the transmission apparatus according to the second embodiment of the present invention. The metal shielding layer 108 includes an extension section 130. The extension section 130 is connected to the pin 208 without the metal shielding layer connecting line 110.

Accordingly, the transmission apparatus is provided to reduce costs of the wire cables and layouting the same by combining the signal transmission lines and the power lines. In addition, huge costs of using the communication technology of the power lines are saved.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A transmission apparatus comprising:

a wire cable having an insulating external layer, a differential signal line group, an AC power line group, and a metal shielding layer; the insulating external layer covering the differential signal line group, the AC power line group, and the metal shielding layer; the differential signal line group having a plurality of signal transmission lines; the AC power line group having a plurality of power lines; the metal shielding layer isolating the differential signal line group and the AC power line group; and at least one connector having an insulating external case and a plurality of conductive terminals; the insulating external case covering the conductive terminals; each conductive terminal having a pin and the pins of the conductive terminals electrically connected to the signal transmission lines, the power lines, and the metal shielding layer.

2. The transmission apparatus of claim 1, wherein the metal shielding layer covers the differential signal line group or the AC power line group.

3. The transmission apparatus of claim 2, wherein the wire cable further has a metal shielding layer connecting line, the insulating external layer covers the metal shielding layer connecting line, the metal shielding layer connecting line is electrically contacted to the metal shielding layer and electrically connected to the pin of the conductive terminal.

4. The transmission apparatus of claim 3, wherein the wire cable further has an insulating encapsulating layer, the insulating encapsulating layer covers the metal shielding layer and the metal shielding layer connecting line.

5. The transmission apparatus of claim 2, wherein the metal shielding layer has an extension section and the extension section is connected to the pin of the conductive terminal.

6. The transmission apparatus of claim 1, wherein the wire cable further has a packing stuff, the packing stuff fills gaps between the differential signal line group, the AC power line group, and the metal shielding layer.

7. The transmission apparatus of claim 1, wherein the signal transmission lines are wound to each other.

8. The transmission apparatus of claim 1, wherein the power lines are wound to each other.

9. The transmission apparatus of claim 6, wherein an amount of the signal transmission lines is two, an amount of the power lines is four, an amount of the conductive terminals is seven; the conductive terminals are electrically connected to the two signal transmission lines, the four power lines, and the metal shielding layer.

10. The transmission apparatus of claim 1, wherein an amount of the connector is two; one of the connectors is a convex male connector and the other of the connectors is a concave female connector.

11. The transmission apparatus of claim 1, wherein all of the power lines are hot lines.

12. The transmission apparatus of claim 1, wherein one part of the power lines are hot lines and the rest part of the power lines are neutral lines.

13. The transmission apparatus of claim 1, wherein one part of the power lines are hot lines and the rest part of the power lines are ground lines.

14. The transmission apparatus of claim 1, wherein one part of the power lines are hot lines, one part of the power lines are neutral lines, and the rest part of the power lines are ground lines.

* * * * *